US010601117B2

(12) United States Patent
Wang et al.

(10) Patent No.: US 10,601,117 B2
(45) Date of Patent: Mar. 24, 2020

(54) ANTENNA AND MOBILE TERMINAL

(71) Applicant: Huawei Device Co., Ltd., Dongguan, Guangdong (CN)

(72) Inventors: Hanyang Wang, Reading (GB); Jianming Li, Shanghai (CN)

(73) Assignee: HUAWEI DEVICE CO., LTD., Dongguan (CN)

( * ) Notice: Subject to any disclaimer, the term of this patent is extended or adjusted under 35 U.S.C. 154(b) by 0 days.

(21) Appl. No.: 16/403,822

(22) Filed: May 6, 2019

(65) Prior Publication Data

US 2019/0260113 A1 Aug. 22, 2019

Related U.S. Application Data

(63) Continuation of application No. 16/057,374, filed on Aug. 7, 2018, now Pat. No. 10,320,060, which is a (Continued)

(51) Int. Cl.
*H01Q 1/24* (2006.01)
*H01Q 5/00* (2015.01)

(Continued)

(52) U.S. Cl.
CPC ..... *H01Q 1/243* (2013.01); *H01Q 1/36* (2013.01); *H01Q 1/38* (2013.01); *H01Q 1/48* (2013.01);

(Continued)

(58) Field of Classification Search
CPC ..... H01Q 1/48; H01Q 1/243; H01Q 1/38; H01Q 1/36; H01Q 9/42; H01Q 9/0414;

(Continued)

(56) References Cited

U.S. PATENT DOCUMENTS 6,466,170 B2 10/2002 Zhou
7,768,466 B2 * 8/2010 Chi ..... H01Q 9/26 343/700 MS (Continued)

FOREIGN PATENT DOCUMENTS

CN 101835282 A 9/2010
CN 102315513 A 1/2012

(Continued)

OTHER PUBLICATIONS

Machine Translation and Abstract of Chinese Publication No. CN103545599, Jan. 29, 2014, 11 pages.

(Continued)

*Primary Examiner* — Hai V Tran
(74) *Attorney, Agent, or Firm* — Conley Rose, P.C.

(57) ABSTRACT

An antenna includes a first radiation part, a matching circuit, and a feed source, where the first radiation part includes a first radiator, a second radiator, and a capacitor structure. A first end of the first radiator is connected to the feed source using the matching circuit, the feed source is connected to a grounding part, a second end of the first radiator is connected to a first end of the second radiator using the capacitor structure, a second end of the second radiator is connected to the grounding part, the first radiation part is configured to generate a first resonance frequency, and a length of the second radiator is one-eighth of a wavelength corresponding to the first resonance frequency which helps to reduce an antenna length, and a volume of a mobile terminal.

20 Claims, 7 Drawing Sheets

Related U.S. Application Data continuation of application No. 15/025,714, filed as application No. PCT/CN2014/074299 on Mar. 28, 2014, now Pat. No. 10,224,605.

(51) Int. Cl.

| | |
|---|---|
| ***H01Q 1/38*** | (2006.01) |
| ***H01Q 5/378*** | (2015.01) |
| ***H01Q 5/321*** | (2015.01) |
| ***H01Q 1/36*** | (2006.01) |
| ***H01Q 9/42*** | (2006.01) |
| ***H01Q 7/00*** | (2006.01) |
| ***H01Q 1/48*** | (2006.01) |
| ***H01Q 9/04*** | (2006.01) |

(52) U.S. Cl.

CPC ..... *H01Q 5/00* (2013.01); *H01Q 5/321* (2015.01); *H01Q 5/378* (2015.01); *H01Q 7/00* (2013.01); *H01Q 9/0414* (2013.01); *H01Q 9/42* (2013.01)

(58) Field of Classification Search

CPC ..... H01Q 5/00; H01Q 5/378; H01Q 5/321; H01Q 1/24; H01Q 7/00

USPC ..... 343/702, 700 MS

See application file for complete search history.

(56) References Cited

U.S. PATENT DOCUMENTS

| | | | | |
|---|---|---|---|---|
| 7,786,940 | B2 | 8/2010 | Hirano | |
| 8,581,799 | B2 | 11/2013 | Choi et al. | |
| 8,854,273 | B2 | 10/2014 | Li et al. | |
| 2002/0105474 | A1 | 8/2002 | Kitamura et al. | |
| 2005/0162324 | A1 | 7/2005 | Sato et al. | |
| 2007/0069958 | A1 | 3/2007 | Ozkar | |
| 2007/0159399 | A1 | 7/2007 | Perunka et al. | |
| 2009/0256763 | A1 | 10/2009 | Chi et al. | |
| 2009/0273531 | A1 | 11/2009 | Ishizuka et al. | |
| 2009/0278755 | A1 | 11/2009 | Shoji | |
| 2010/0026596 | A1 | 2/2010 | Nishio et al. | |
| 2010/0127941 | A1 | 5/2010 | Chiang et al. | |
| 2011/0102290 | A1 | 5/2011 | Milosavljevic | |
| 2011/0156963 | A1 | 6/2011 | Rajgopal et al. | |
| 2011/0234465 | A1 | 9/2011 | Park et al. | |
| 2012/0188135 | A1 | 7/2012 | Wong et al. | |
| 2012/0280883 | A1 | 11/2012 | Ying | |
| 2013/0027260 | A1 | 1/2013 | Jeon et al. | |
| 2013/0045777 | A1 | 2/2013 | Yang et al. | |
| 2013/0050036 | A1 | 2/2013 | Kashiwagi et al. | |
| 2013/0088399 | A1 | 4/2013 | Jeon et al. | |
| 2013/0122828 | A1 | 5/2013 | Choi | |
| 2013/0325149 | A1 | 12/2013 | Manssen et al. | |
| 2014/0111386 | A1 | 4/2014 | Xu | |
| 2014/0192725 | A1* | 7/2014 | Black | H04W 72/10 370/329 |
| 2014/0292602 | A1 | 10/2014 | Suzuki et al. | |
| 2014/0306856 | A1 | 10/2014 | Fan et al. | |

FOREIGN PATENT DOCUMENTS

| | | | |
|---|---|---|---|
| CN | 102593572 | A | 7/2012 |
| CN | 202444054 | A | 9/2012 |
| CN | 103403962 | A | 11/2013 |
| CN | 103545599 | A | 1/2014 |
| CN | 104471789 | A | 3/2015 |
| EP | 2637251 | A2 | 9/2013 |
| EP | 3091609 | A1 | 11/2016 |
| JP | 2004236273 | A | 8/2004 |
| JP | 2012182726 | A | 9/2012 |
| WO | 2013076894 | A1 | 5/2013 |
| WO | 2013132972 | A1 | 9/2013 |

OTHER PUBLICATIONS

Machine Translation and Abstract of Chinese Publication No. CN104471789, Mar. 25, 2015, 19 pages.

Machine Translation and Abstract of Japanese Application No. JP2012182726, Sep. 20, 2012, 22 pages.

Machine Translation and Abstract of International Publication No. WO2013132972, Sep. 12, 2013, 15 pages.

Machine Translation and Abstract of Chinese Publication No. CN102315513, Jan. 11, 2012, 16 pages.

Machine Translation and Abstract of Chinese Publication No. CN102593572, Jul. 18, 2012, 8 pages.

Machine Translation and Abstract of Japanese Publication No. JP2004236273, Sep. 19, 2004, 11 pages.

Machine Translation and Abstract of International Publication No. WO2013076894, May 30, 2013, 72 pages.

Wong, K.,"4G/Multiband Handheld Device Ground Antennas", 2013 Asia-Pacific Microwave Conference Proceedings, Nov. 5-8, 2013, 3 pages.

Liu, Y., et al., "Dual-band PIFA using resonated loop feed structure", Electronics Letters, vol. 48 No. 6, Mar. 15, 2012, 2 pages.

Wong, K., et al.,"Internal Eight-Band WWAN/LTE Handset Antenna Using Loopshorting Strip and Chipcapacitor-Loaded Feeding Strip for Bandwidth Enhancement", Microwave and Optical Technology Letters, vol. 53, No. 6, Jun. 2011, 6 pages.

Jeon, S, et al.,"Mobile Terminal Antenna Using a Planar Inverted E-Feed Structure for Enhanced Impedance Bandwidth", Microwave and Optical Technology Letters, vol. 54, No. 9, Sep. 2012, 7 pages.

Chen, S., et al.,"Planar Strip Monopole With a Chip-Capacitor-Loaded Loop Radiating Feed for LTE/WWAN Slim Mobile Phone Application", Microwave and Optical Technology Letters, vol. 53, No. 4, Apr. 2011, 7 pages.

Wong, K., et al.,"Small-Size LTE/WWAN Printed Loop Antenna With an Inductively Coupled Branch Strip for Bandwidth Enhancement in the Tablet Computer", IEEE Transactions on Antennas and Propagation, vol. 61, No. 12, Dec. 2013, 8 pages.

Wong, K., et al., "Small-Size Planar LTE/WWAN Antenna and Antenna Array Formed by the Same for Tablet Computer Application", Microwave and Optical Technology Letters, vol. 55, No. 8, Aug. 2013, 7 pages.

Ban, Y., et al., "Small-size printed coupled-fed antenna for eight-band LTE/GSM/UMTS wireless wide area network operation in an internal mobile handset", IET Microwaves, Antennas & Propagation, vol. 7, Iss. 6, 2013, 9 pages.

Wong, K., et al., "Wideband Surface-Mount Chip Antenna for Eight-Band LTE/WWAN Slim Mobile Phone Application", Microwave and Optical Technology Letters, vol. 52, No. 11, Nov. 2010, 7 pages.

Chang, et al., "Penta-Band One-Eighth Wavelength PIFA for Internal Mobile Phone Antenna," 2009, 4 pages.

Foreign Communication From a Counterpart Application, European Application No. 18181518.4, Extended European Search Report dated Mar. 21, 2019, 11 pages.

Foreign Communication From a Counterpart Application, Chinese Application No. 201480001478.4, Chinese Office Action dated Oct. 29, 2015, 10 pages.

Foreign Communication From a Counterpart Application, Chinese Application No. 201610621888.X, Chinese Office Action dated Jun. 28, 2018, 9 pages.

Foreign Communication From a Counterpart Application, European Application No. 14887184.1, European Notice of Allowance dated Apr. 4, 2018, 7 pages.

Foreign Communication From a Counterpart Application, European Application No. 14887184.1, Extended European Search Report dated Oct. 7, 2016, 9 pages.

(56) References Cited

OTHER PUBLICATIONS

Foreign Communication From a Counterpart Application, PCT Application No. PCT/CN2014/074299, English Translation of International Search Report dated Dec. 31, 2014, 2 pages.
Foreign Communication From a Counterpart Application, PCT Application No. PCT/CN2014/074299, English Translation of Written Opinion dated Dec. 31, 2014, 7 pages.

* cited by examiner

ANTENNA AND MOBILE TERMINAL

CROSS-REFERENCE TO RELATED APPLICATIONS

This application is a continuation of U.S. patent application Ser. No. 16/057,374 filed on Aug. 7, 2018, which is a continuation of U.S. patent application Ser. No. 15/025,714 filed on Mar. 29, 2016, now U.S. Pat. No. 10,224,605, which is a National Stage of International Application No. PCT/CN2014/074299 filed on Mar. 28, 2014. All of the aforementioned patent applications are hereby incorporated by reference in their entireties.

TECHNICAL FIELD

The present disclosure relates to the field of antenna technologies, and in particular, to an antenna and a mobile terminal.

BACKGROUND

The advent of the fourth generation (4G) mobile communications development Long Term Evolution (LTE) raises an increasingly high bandwidth requirement for a mobile terminal, for example, a cell phone. In a case in which a cell phone becomes increasingly slimmer and antenna space is insufficient, it is a significant challenge to design an antenna that has relatively wide bandwidth and can meet use for current and future second generation (2G)/third generation (3G)/4G communications. Especially, it is a big challenge that antenna bandwidth needs to cover a low frequency band (698-960 megahertz (MHz)) and miniaturization of the cell phone needs to be met.

In some antenna solutions of an existing cell phone, such as a planar inverted-F antenna (PIFA), an inverted-F antenna (IFA), a monopole antenna, a T-shaped antenna, and a loop antenna, an antenna length needs to be at least one-fourth to one-half of a wavelength corresponding to a low frequency, and therefore it is difficult for an existing terminal product to implement miniaturization.

SUMMARY

Embodiments of the present disclosure provide an antenna whose size can be reduced and a mobile terminal.

An embodiment of the present disclosure provides an antenna, including a first radiation part, a matching circuit, and a feed source, where the first radiation part includes a first radiator, a second radiator, and a capacitor structure, a first end of the first radiator is connected to the feed source using the matching circuit, the feed source is connected to a grounding part, a second end of the first radiator is connected to a first end of the second radiator using the capacitor structure, a second end of the second radiator is connected to the grounding part, the first radiation part is configured to generate a first resonance frequency, and a length of the second radiator is one-eighth of a wavelength corresponding to the first resonance frequency.

In a first possible implementation manner, the first end of the second radiator and the second end of the first radiator are close to each other and spaced, to form the capacitor structure.

In a second possible implementation manner, the capacitor structure is a capacitor, and the second end of the first radiator is connected to the first end of the second radiator using the capacitor structure is further connected the second end of the first radiator to the first end of the second radiator using the capacitor.

In a third possible implementation manner, the capacitor structure includes a first branch structure and a second branch structure. The first branch structure includes at least one pair of mutually paralleled first branches. The second branch structure includes at least one second branch, the first branches are spaced, and the second branch is located between the two first branches and is spaced from the first branches.

With reference to any one of the foregoing possible implementation manners, in a fourth possible implementation manner, the antenna further includes a second radiation part, a first end of the second radiation part is connected to the second end of the first radiator, and the second radiation part and the capacitor structure generate a first high-frequency resonance frequency.

With reference to any one of all the foregoing possible implementation manners, in a fifth possible implementation manner, the antenna further includes a third radiation part, a first end of the third radiation part is connected to the first end of the second radiator, and the third radiation part and the capacitor structure generate a second high-frequency resonance frequency.

With reference to any one of all the foregoing possible implementation manners, in a sixth possible implementation manner, the antenna further includes a fourth radiation part, a first end of the fourth radiation part is connected to the first end of the second radiator, and the fourth radiation part and the capacitor structure generate a low-frequency resonance frequency and a high-order resonance frequency.

According to another aspect, the present disclosure provides a mobile terminal, including an antenna, a radio frequency processing unit, and a baseband processing unit, where the antenna includes a first radiation part, a matching circuit, and a feed source, where the first radiation part includes a first radiator, a second radiator, and a capacitor structure, a first end of the first radiator is connected to the feed source using the matching circuit, the feed source is connected to a grounding part, a second end of the first radiator is connected to a first end of the second radiator using the capacitor structure, a second end of the second radiator is connected to the grounding part, the first radiation part is configured to generate a first resonance frequency, and a length of the second radiator is one-eighth of a wavelength corresponding to the first resonance frequency. The baseband processing unit is connected to the feed source using the radio frequency processing unit, and the antenna is configured to transmit a received radio signal to the radio frequency processing unit, or convert a transmit signal of the radio frequency processing unit into an electromagnetic wave, and transmit the electromagnetic wave. The radio frequency processing unit is configured to perform frequency selection processing, amplification processing, and down-conversion processing on the radio signal received by the antenna, convert the radio signal into an intermediate frequency signal or a baseband signal, and transmit the intermediate frequency signal or the baseband signal to the baseband processing unit, or is configured to transmit, using the antenna, a baseband signal or an intermediate frequency signal that is sent by the baseband processing unit and that is obtained by means of up-conversion and amplification, and the baseband processing unit is configured to perform processing on the received intermediate frequency signal or the received baseband signal.

In a first possible implementation manner, the first end of the second radiator and the second end of the first radiator are close to each other and spaced, to form the capacitor structure.

In a second possible implementation manner, the capacitor structure is a capacitor, and that a second end of the first radiator is connected to a first end of the second radiator using the capacitor structure is further connected the second end of the first radiator to the first end of the second radiator using the capacitor.

In a third possible implementation manner, the capacitor structure includes a first branch structure and a second branch structure, the first branch structure includes at least one pair of mutually paralleled first branches, the second branch structure includes at least one second branch, the first branches are spaced, and the second branch is located between the two first branches and is spaced from the first branches.

With reference to any one of the foregoing implementation manners, in a fourth possible implementation manner, the antenna further includes a second radiation part, a first end of the second radiation part is connected to the second end of the first radiator, and the second radiation part and the capacitor structure generate a first high-frequency resonance frequency.

With reference to any one of the foregoing implementation manners, in a fifth possible implementation manner, the antenna further includes a third radiation part, a first end of the third radiation part is connected to the first end of the second radiator, and the third radiation part and the capacitor structure generate a second high-frequency resonance frequency.

With reference to any one of the foregoing implementation manners, in a sixth possible implementation manner, the antenna further includes a fourth radiation part, a first end of the fourth radiation part is connected to the first end of the second radiator, and the fourth radiation part and the capacitor structure generate a low-frequency resonance frequency and a high-order resonance frequency.

In a seventh possible implementation manner, the first radiation part is located on an antenna bracket.

According to the antenna and the mobile terminal provided in the embodiments of the present disclosure, the first end and the second end of the second radiator are utilized to form a parallel-distributed inductor in a composite right/left-handed transmission line principle, and the capacitor structure is a series-distributed capacitor structure in the composite right/left-handed transmission line principle such that a length of the second radiator is one-eighth of a wavelength corresponding to a low frequency, thereby reducing a length of the antenna, and further reducing a volume of the mobile terminal.

BRIEF DESCRIPTION OF DRAWINGS

To describe the technical solutions in the embodiments of the present disclosure more clearly, the following briefly introduces the accompanying drawings required for describing the embodiments. The accompanying drawings in the following description show merely some embodiments of the present disclosure, and a person of ordinary skill in the art may still derive other drawings from these accompanying drawings without creative efforts.

DESCRIPTION OF EMBODIMENTS

The following clearly and completely describes the technical solutions in the implementation manners of the present disclosure with reference to the accompanying drawings in the implementation manners of the present disclosure.

Figure 1:
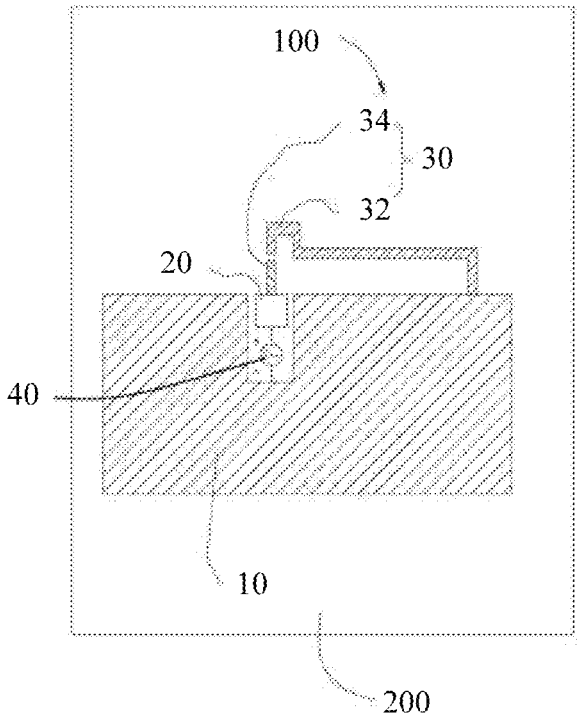
FIG. 1 is a schematic diagram of an antenna according to a first embodiment of the present disclosure.

Referring to FIG. 1, an antenna 100 provided in a first implementation manner of the present disclosure includes a first radiation part 30, a matching circuit 20, and a feed source 40, where the first radiation part 30 includes a first radiator 34, a second radiator 32, and a capacitor structure (the capacitor structure is not denoted in FIG. 1, and for a capacitor structure, refer to 36*a* in FIGS. 4 and 36*c* in FIG. 6) located between the first radiator 34 and the second radiator 32. A first end of the first radiator 34 is connected to the feed source 40 using the matching circuit 20, the feed source 40 is connected to a grounding part 10, a second end of the first radiator 34 is connected to a first end of the second radiator 32 using the capacitor structure, and a second end of the second radiator 32 is connected to the grounding part 10, where the first radiation part 30 is configured to generate a first resonance frequency, and a length of the second radiator 32 is one-eighth of a wavelength corresponding to the first resonance frequency. The first resonance frequency may be corresponding to f1 in FIG. 3 and FIG. 7.

The first resonance frequency may be a low-frequency resonance frequency.

According to the antenna 100 provided in this embodiment of the present disclosure, the first end and the second end of the second radiator 32 are utilized to form a parallel-distributed inductor in a composite right/left-handed transmission line principle, and the capacitor structure is a series-distributed capacitor structure in the composite right/left-handed transmission line principle such that the length of the second radiator 32 is one-eighth of a wavelength corresponding to the low frequency, thereby reducing a length of the antenna 100.

Figure 2:
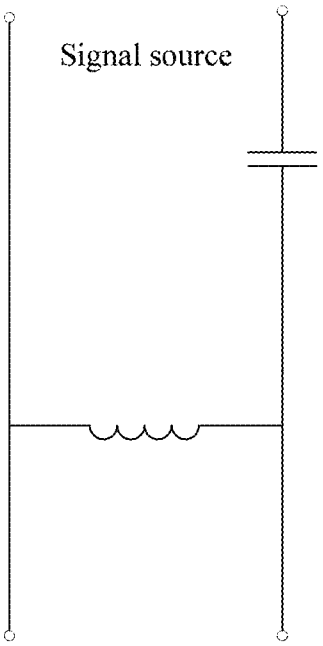
FIG. 2 is a schematic circuit diagram of an equivalent circuit of the antenna shown in FIG. 1.

The second end of the second radiator 32 is connected to the grounding part 10, the capacitor structure is disposed between the second end of the first radiator 34 and the first end of the second radiator 32 and is connected to the second radiator 32 in series, and the second radiator 32 and the capacitor structure generate a low-frequency resonance frequency. For the antenna, a factor that determines a resonance frequency includes a capacitance value and an inductance value, and the second radiator 32 is equivalent to an inductor, therefore, the second radiator 32 and the capacitor structure generate the low-frequency resonance frequency. As shown in FIG. 1, the first radiator 34, the second radiator 32, and the capacitor structure jointly form a core component in a left-handed transmission line principle, and in a path in which a signal flows, the signal passes through the capacitor structure, and then passes through an inductor connected in parallel to be connected to the grounding part 10, which forms a left-handed transmission structure. The first end and the second end of the second radiator 32 form a parallel-distributed inductor in the left-handed transmission line principle, the capacitor structure is a series-distributed capacitor structure in the left-handed transmission line principle. A schematic diagram of an equivalent circuit of the antenna is shown in FIG. 2. According to the left-handed transmission line principle, the length of the second radiator 32 is one-eighth of the wavelength corresponding to the low frequency, that is, the length of the antenna 100 is one-eighth of the wavelength corresponding to the low frequency. Compared with an antenna in the some approaches whose length needs to be at least one-fourth to one-half of the wavelength corresponding to a low frequency, the antenna 100 in this embodiment of the present disclosure has an advantage of a small size.

Figure 3:
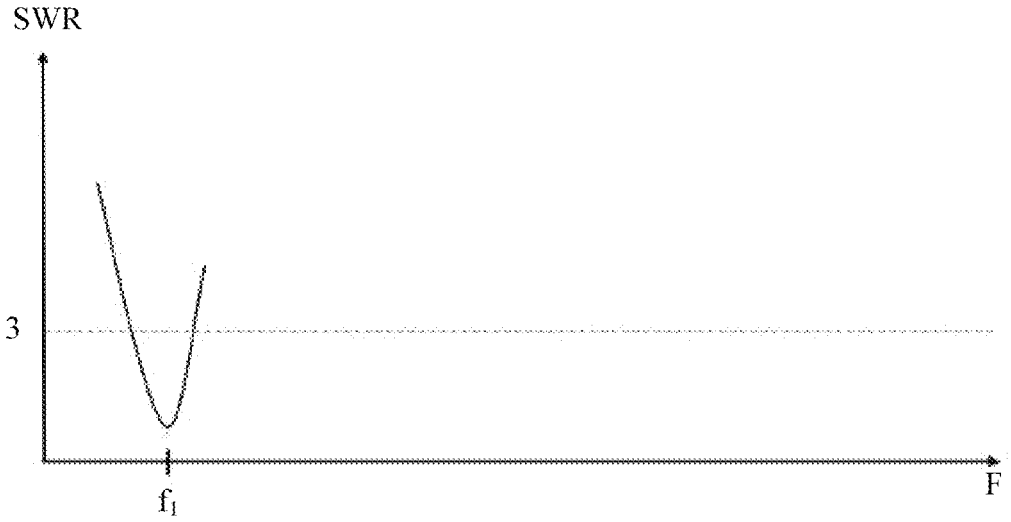
FIG. 3 is a schematic diagram of a resonance frequency generated by the antenna shown in FIG. 1.

Furthermore, the capacitor structure and the distributed inductor between the second end and the first end of the second radiator 32 conform to the left-handed transmission line principle, and for the generated first resonance frequency (for example, the first resonance frequency may be the low-frequency resonance frequency) f1, refer to FIG. 3. Because the factor that determines a value of the first resonance frequency includes the capacitance value and the inductance value, the resonance frequency may be adjusted by changing a length of the distributed inductor between the first end and the second end of the second radiator 32, or fine adjustment may be performed on the resonance frequency by changing a value of the series-distributed capacitor structure.

If the first resonance frequency (low-frequency resonance frequency) of the antenna 100 needs to be decreased, spacing of the capacitor structure needs to be narrowed and/or an inductance value needs to be increased. For example, reducing a distance between the second end of the first radiator 34 and the first end of the second radiator 32 can increase a value of the capacitor structure. Increasing a length between the first end and the second end of the second radiator 32 can increase a value of distributed inductance between the first end and the second end of the second radiator 32. If the first resonance frequency (low-frequency resonance frequency) of the antenna 100 needs to be adjusted to a high-frequency resonance frequency, spacing of the capacitor structure needs to be increased and/or an inductance value needs to be decreased. For example, increasing a distance between the second end of the first radiator 34 and the first end of the second radiator 32 can reduce a value of the capacitor structure. Reducing a length between the first end and the second end of the second radiator 32 can reduce a value of distributed inductance between the first end and the second end of the second radiator 32.

In an implementation manner of the present disclosure, as shown in FIG. 1, the first end of the second radiator 32 and the second end of the first radiator 34 are close to each other and spaced, to form the capacitor structure.

Figure 4:
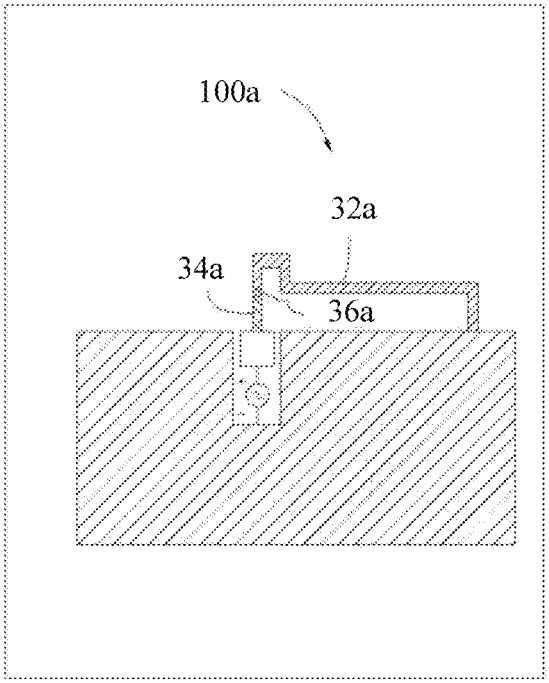
FIG. 4 is a schematic diagram of an antenna according to a second embodiment of the present disclosure.

In another implementation manner of the present disclosure, as shown in FIG. 4, the capacitor structure 36*a* may be a capacitor (the capacitor may be an independent electronic element), and that a second end of the first radiator 34 is connected to a first end of the second radiator 32 using the capacitor structure 36*a* is further connected the second end of the first radiator 34 to the first end of the second radiator 32 using the capacitor.

As shown in FIG. 1, in an optional implementation manner, the first radiator 34 and the second radiator 32 may be microstrips disposed on a circuit board 200. In this case, the first radiation part 30, the matching circuit 20, and the grounding part 10 are all disposed on the circuit board, that is, the first radiation part 30, the matching circuit 20, and the grounding part 10 may be disposed on a same plane of the circuit board 200.

Figure 10:
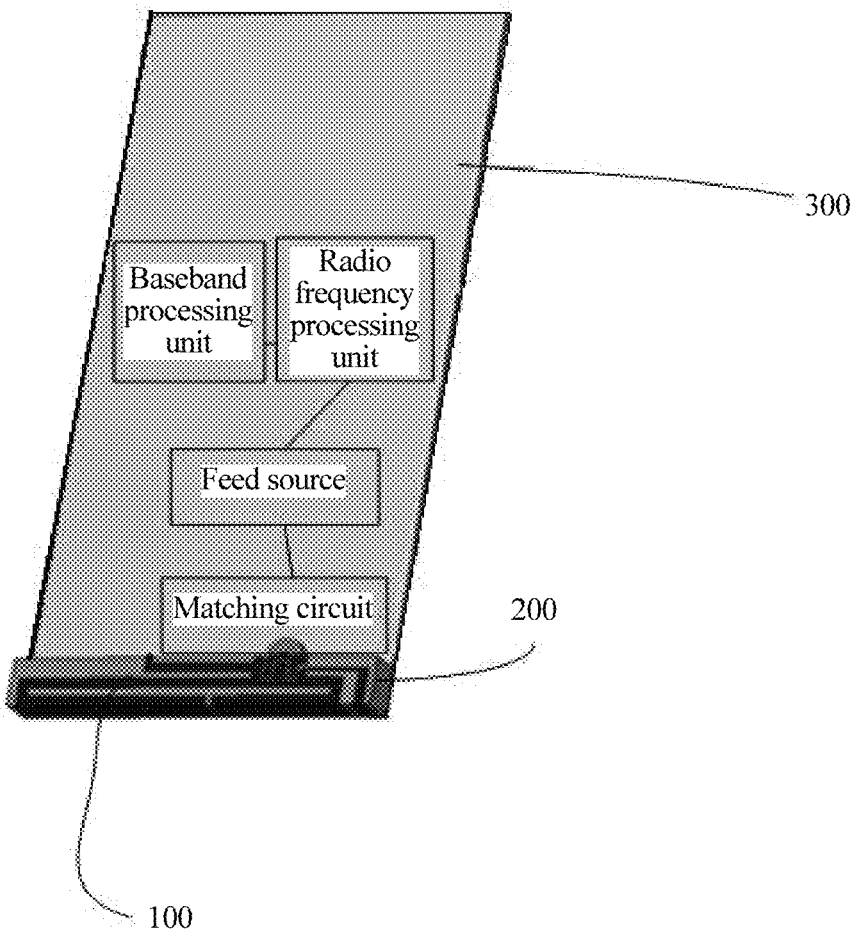
FIG. 10 is a schematic diagram of assembly of a circuit board and an antenna that are of a mobile terminal according to the present disclosure.

In another implementation manner, the first radiator 34 and the second radiator 32 may also be metal sheets. In this case, the first radiator 34 and the second radiator 32 may be formed on a bracket, and as shown in FIG. 10, the bracket is an insulation medium. Optionally, the first radiator 34 and the second radiator 32 may also be suspended in the air.

It may be understood that a shape of the second radiator 32 is not limited in this embodiment of the present disclosure, and the shape of the second radiator 32 may be roughly an L shape. In another implementation manner, the second radiator 32 may be in another winding shape such as a C shape, an M shape, an S shape, a W shape, or an N shape. Because the second radiator 32 is in a winding shape, the length of the second radiator 32 can further be shortened, and in this way, a size of the antenna 100 can further be reduced.

As shown in FIG. 1, in an optional implementation manner, the grounding part 10 is a ground of the circuit board 200. In another implementation manner, the grounding part 10 may also be a grounding metal plate.

Referring to FIG. 3, FIG. 3 is a frequency-standing wave ratio diagram (a frequency response diagram) of the antenna 100 shown in FIG. 1, where a horizontal coordinate represents a frequency in the unit of gigahertz (GHz), and a vertical coordinate represents a standing wave ratio. The first resonance frequency (low-frequency resonance frequency) f1 generated by the antenna 100 shown in FIG. 1 is approximately 800 MHz.

Referring to FIG. 4, FIG. 4 shows an antenna 100*a* according to a second implementation manner of the present disclosure. The antenna 100*a* provided in the second implementation manner and the antenna 100 (referring to FIG. 1) provided in the first implementation manner are basically the same in terms of a structure, and implement similar functions. The antenna 100*a* differs from the antenna 100 in that a capacitor structure 36*a* is connected between a second end of a first radiator 34*a* and a first end of a second radiator 32*a*. In an optional implementation manner, the capacitor structure 36*a* may be a multilayer capacitor or a distributed capacitor. In another implementation manner, the capacitor structure 36*a* may be a variable capacitor or a capacitor that is connected in series or in parallel in multiple forms. The capacitor structure 36*a* may be a variable capacitor, and therefore, a value of variable capacitance may be changed according to an embodiment such that a low-frequency resonance frequency of the antenna 100 in the present disclosure can be changed by adjusting the value of the variable capacitance, thereby improving convenience in use.

Figure 5:
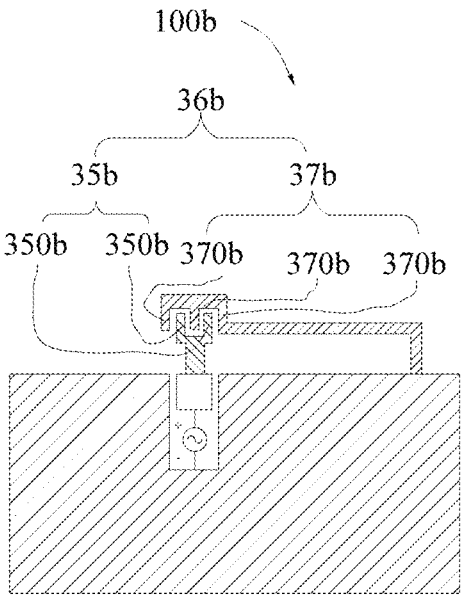
FIG. 5 is a schematic diagram of an antenna according to a third embodiment of the present disclosure.

Referring to FIG. 5, FIG. 5 shows an antenna 100*b* according to a third implementation manner of the present disclosure. The antenna 100*b* provided in the third implementation manner and the antenna 100 (referring to FIG. 1) provided in the first implementation manner are basically the same in terms of a structure, and implement similar functions. The antenna 100*b* differs from the antenna 100 in that a capacitor structure 36*b* includes a first branch structure 35*b* and a second branch structure 37*b*, where the first branch structure 35*b* includes at least one pair of mutually paralleled first branches 350*b*, the second branch structure 37*b* includes at least one second branch 370*b*, the first branches 350*b* are spaced, and the second branch 370*b* is located between the first branches 350*b* and is spaced from the first branches 350*b*. In other words, the capacitor structure 36*b* is collectively formed by the first branches 350*b* and the second branch 370*b*.

As shown in FIG. 5, in an optional implementation manner, there are two first branches 350*b* that are parallel to each other, the two adjacent first branches 350*b* are spaced, there are three second branches 370*b* that are parallel to each other, and one of the first branches 350*b* is located between two adjacent second branches 370*b*.

In another implementation manner, there may be four or more first branches 350*b*, every two adjacent first branches 350*b* are spaced and parallel to each other. In addition, there may be three or more second branches 370*b*, each first branch 350*b* is located between two adjacent second branches 370*b*. A general principle is that every two adjacent second branches 370*b* are spaced and parallel to each other, each first branch 350*b* is located between two adjacent second branches 370*b*, and meanwhile, the second branches 370*b* outnumber the first branches 350*b* by one. Certainly, the foregoing principle may be reversed, that is, the first branches 350*b* outnumber the second branches 370*b* by one, every two adjacent first branches 350*b* are spaced and parallel to each other, and each second branch 370*b* is located between two adjacent first branches 350*b*.

Figure 6:
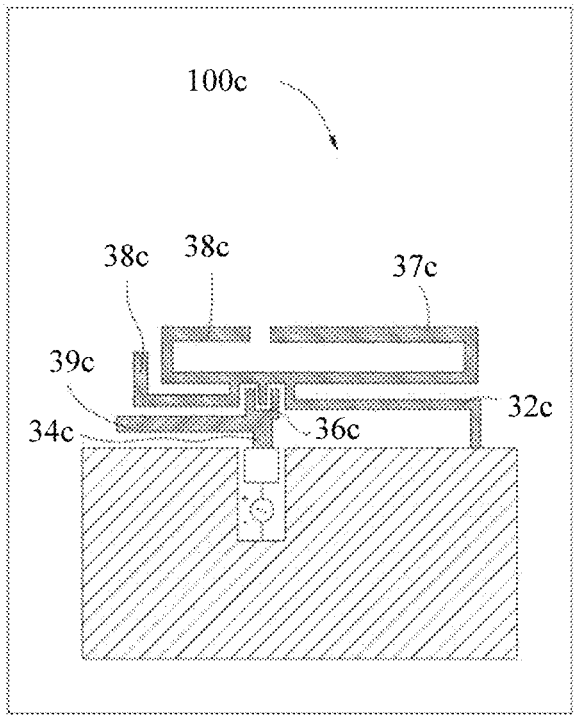
FIG. 6 is a schematic diagram of an antenna according to a fourth embodiment of the present disclosure.
Figure 7:
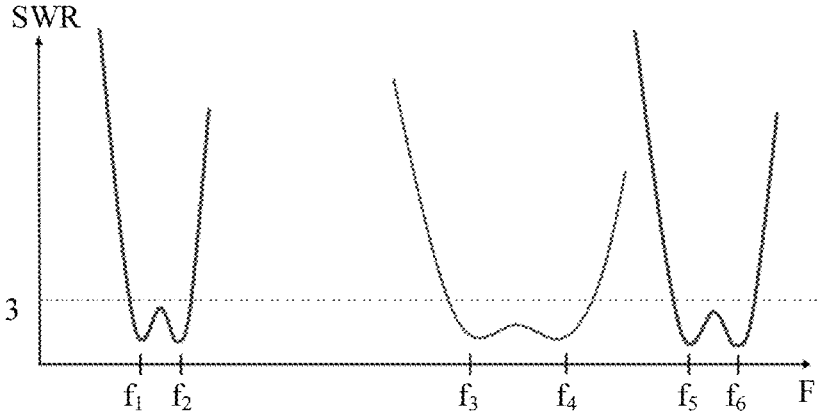
FIG. 7 is a schematic diagram of a resonance frequency generated by the antenna shown in FIG. 6.

Referring to FIG. 6, FIG. 6 shows an antenna 100*c* according to a fourth implementation manner of the present disclosure. The antenna 100*c* provided in the fourth implementation manner and the antenna 100*b* (referring to FIG. 5) provided in the third implementation manner are basically the same in terms of a structure, and implement similar functions. The antenna 100*c* differs from the antenna 100*b* in that the antenna 100*c* further includes a second radiation part 39*c*, a first end of the second radiation part 39*c* is connected to a second end of a first radiator 34*c*, and the second radiation part 39*c* and a capacitor structure 36*c* generate a first high-frequency resonance frequency. As shown in FIG. 7, the first high-frequency resonance frequency may be corresponding to f6 in FIG. 7.

As a further improvement of the present disclosure, the antenna 100*c* further includes at least one third radiation part 38*c*, a first end of the third radiation part 38*c* is connected to a first end of a second radiator 32*c*, and the third radiation part 38*c* and the capacitor generate a second high-frequency resonance frequency, where the second high-frequency resonance frequency may be corresponding to f4 or f5 in FIG. 7. The antenna 100*c* in this implementation manner includes two third radiation parts 38*c*, and the two third radiation parts 38*c* generate two second high-frequency resonance frequencies, which are respectively corresponding to f4 and f5 in FIG. 7. One third radiation part 38*c* is located between the other third radiation part 38*c* and the second radiation part 39*c*, that is, one third radiation part 38*c* is close to the second radiation part 39*c*, and the other third radiation part 38*c* is away from the second radiation part 39*c*, where the third radiation part 38*c* close to the second radiation part 39*c* may be corresponding to the second high-frequency resonance frequency f5, and the third radiation part 38*c* away from the second radiation part 39*c* may be corresponding to the second high-frequency resonance frequency f4.

It may be understood that in this embodiment, the third radiation part 38*c* away from the second radiation part 39*c* corresponds to the second high-frequency resonance frequency f4, the third radiation part 38*c* close to the second radiation part 39*c* corresponds to the second high-frequency resonance frequency f5, and the second radiation part 39*c* corresponds to the first high-frequency resonance frequency f6. Optionally, f4 may be corresponding to the third radiation part 38*c* close to the second radiation part 39*c* or may be corresponding to the second radiation part 39*c*, 5 may be corresponding to the third radiation part 38*c* away from the second radiation part 39*c* and may be corresponding to the second radiation part 39*c*, and f6 may be corresponding to the third radiation part 38*c* away from the second radiation part 39*c* or the third radiation part 38*c* close to the second radiation part 39*c*. Furthermore, how f4 to f6 correspond to the third radiation part 38*c* away from the second radiation part 39*c*, the third radiation part 38*c* close to the second radiation part 39*c*, and the second radiation part 39*c* may be determined according to lengths of the third radiation part 38*c* away from the second radiation part 39*c*, the third radiation part 38*c* close to the second radiation part 39*c*, and the second radiation part 39*c*, and a longer length corresponds to a lower frequency. For example, if a length of the third radiation part 38*c* close to the second radiation part 39*c* is greater than that of the second radiation part 39*c*, and the length of the second radiation part 39*c* is greater than a length of the third radiation part 38*c* away from the second radiation part 39*c*, the third radiation part 38*c* close to the second radiation part 39*c* corresponds to f4, the second radiation part 39*c* corresponds to f5, and the length of the third radiation part 38*c* away from the second radiation part 39*c* corresponds to f6.

Optionally, each third radiation part 38*c* is in a shape of "⊏", the two third radiation parts 38*c* form two parallel branches, the two third radiation parts have one common endpoint, and the common endpoint is connected to the first end of the second radiator 32*c*.

As a further improvement of this embodiment of the present disclosure, one end of a fourth radiation part 37*c* is connected to the first end of the second radiator 32*c*, and the other end of the fourth radiation part 37*c* is in an open state.

Optionally, the fourth radiation part 37*c* and the second radiator 32*c* may be located on a same side of the capacitor structure 36*c*.

The fourth radiation part 37*c* and the capacitor structure 36*c* generate a low-frequency resonance frequency and a high-order resonance frequency, where the low-frequency resonance frequency may be corresponding to f2 in FIG. 7, and the high-order resonance frequency corresponds to f3 in FIG. 7.

Optionally, the fourth radiation part 37*c* is in a shape of "⊏".

In an optional implementation manner, the fourth radiation part 37*c* is opposite to one of the third radiation parts 38*c* (for example, the third radiation part 38*c* away from the second radiation part 39*c*), and an open end of the fourth radiation part 37*c* is opposite to and not in contact with an open end of one of the third radiation parts 38*c*, to form a coupled structure. It may be understood that the open end of the fourth radiation part 37*c* is opposite to and not in contact with the open end of one of the third radiation parts 38*c*, and no coupled structure may be formed.

In another implementation manner, in addition to the first radiator 34 and the second radiator 32, the antenna 100 in the fourth implementation manner may further include only the second radiation part 39*c* or/and at least one third radiation part 38c or/and the fourth radiation part 37c, that is, any combination of the second radiation part 39c, the third radiation part 38c, and the fourth radiation part 37c. Quantities of second radiation parts 39c, third radiation parts 38c, and fourth radiation parts 37c may also be increased or decreased according to an embodiment.

The antenna 100 can generate multiple resonance frequencies shown in FIG. 7, where f1 is a low-frequency resonance frequency generated by the second radiator 32c and the low-frequency resonance frequency is a first resonance frequency, f2 is a low-frequency resonance frequency generated by the fourth radiation part 37c, f3 is a high-order resonance frequency generated by the fourth radiation part 37c, f4 and f5 are second high-frequency resonance frequencies generated by the two third radiation parts 38c, and f6 is a first high-frequency resonance frequency generated by the second radiation part 39c such that the antenna 100 in this embodiment of the present disclosure is a broadband antenna 100 that can cover a high frequency band and a low frequency band.

The resonance frequencies f1 and f2 can cover frequencies in low frequency bands of Global System for Mobile Communications (GSM)/Wideband Code Division Multiple Access (WCDMA)/Universal Mobile Telecommunications System (UMTS)/LTE, the resonance frequency f3 is used to cover frequencies in a frequency band of LTE B21, and the high-frequency resonance frequencies f4, f5, and f6 cover frequencies in high frequency bands of Digital Cellular System (DCS)/Personal Communications Service (PCS)/WCDMA/UMTS/LTE.

In an optional implementation manner, f1=800 MHz, f2=920 MHz, f3=1800 MHz, f4=2050 MHz, f5=2500 MHz, and f6=2650 MHz. In other words, a low frequency of the antenna 100 in the present disclosure covers frequencies in a frequency band of 800 MHz-920 MHz, and a high frequency covers frequencies in a frequency band of 1800 MHz-2650 MHz.

Figure 8:
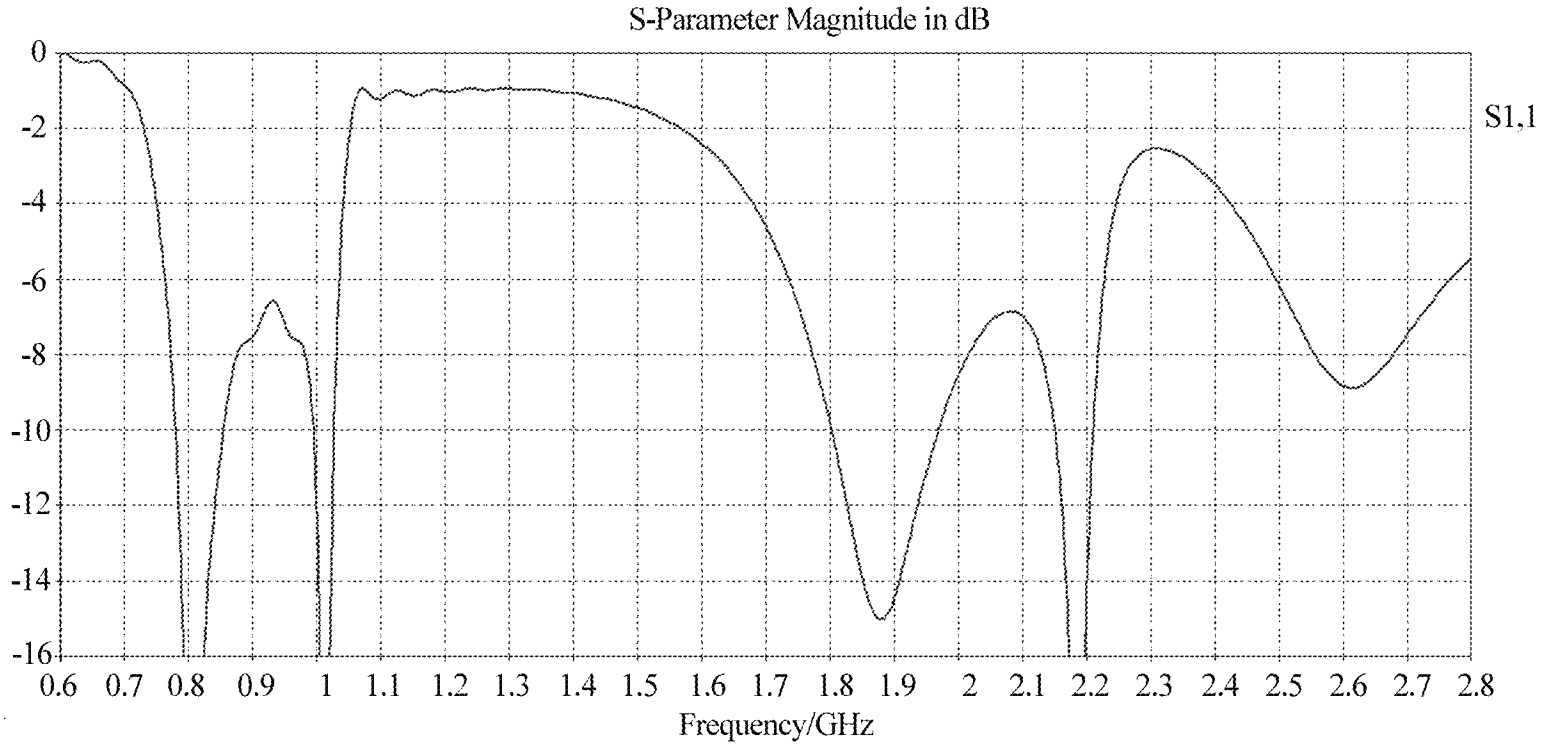
FIG. 8 is a frequency response diagram of the antenna shown in FIG. 6.

FIG. 8 is a frequency-standing wave ratio diagram (frequency response diagram) of the antenna 100c shown in FIG. 6, where a horizontal coordinate represents a frequency in the unit of GHz, and a vertical coordinate represents a standing wave ratio in the unit of decibel (dB). It may be found from FIG. 8 that the antenna 100 may excite low-frequency double resonance, and the low-frequency double resonance and multiple high-frequency resonance generate broadband coverage.

Figure 9:
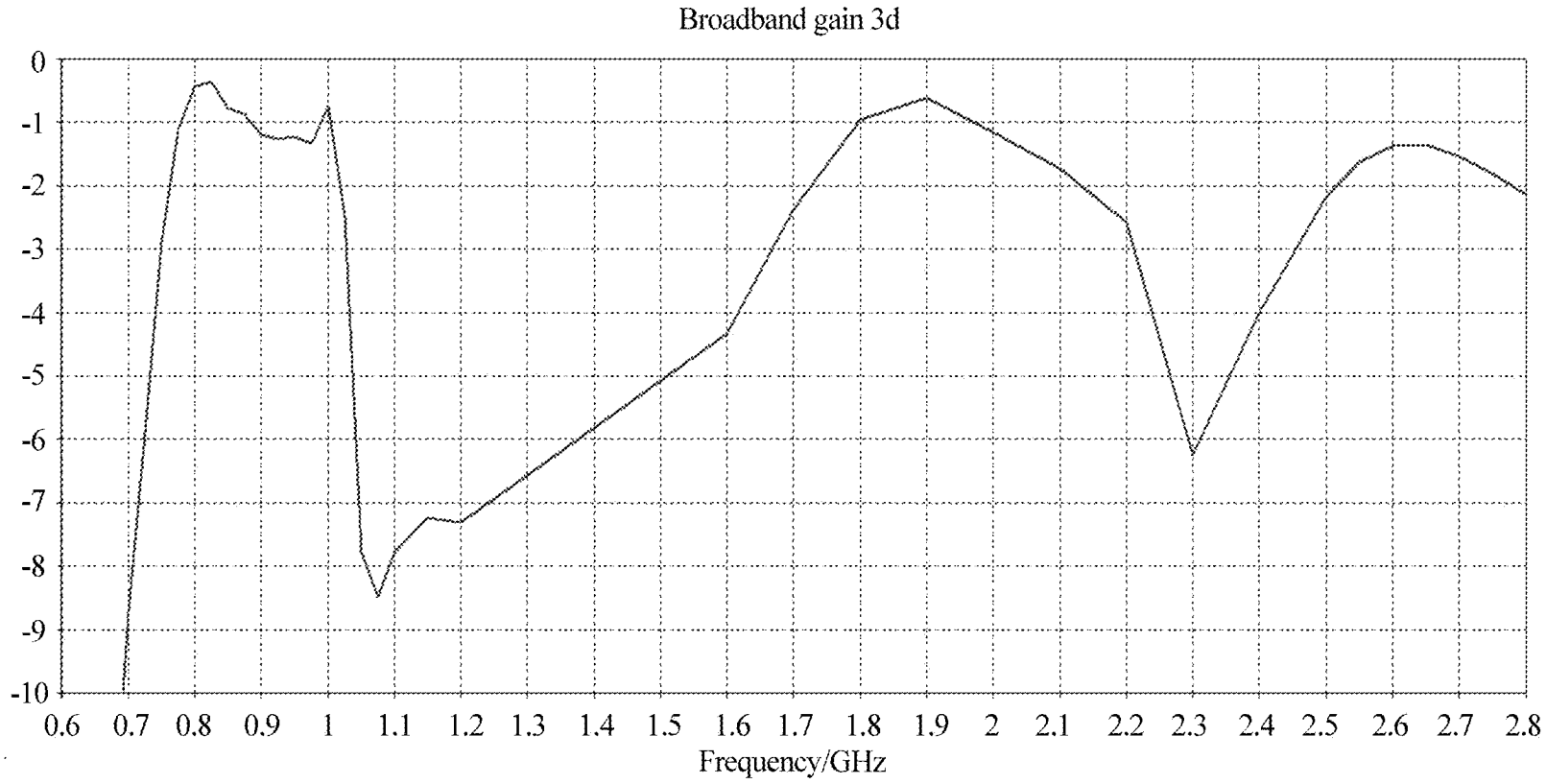
FIG. 9 is a radiation efficiency diagram of the antenna shown in FIG. 6.

FIG. 9 is a radiation efficiency diagram of the antenna 100 shown in FIG. 6, where a horizontal coordinate represents a frequency, and a vertical coordinate represents a gain. It may be found from FIG. 9 that radiation efficiency of the antenna 100c is higher.

In conclusion, the antenna 100c in the present disclosure can generate a low-frequency resonance frequency and a high-frequency resonance frequency, where the low-frequency frequency may cover a frequency band of 800 MHz-920 MHz, and the high-frequency frequency may cover a frequency band of 1800 MHz-2650 MHz. By adjusting a distributed inductor and a series capacitor, the resonance frequencies can cover a frequency band required in a current 2G/3G/4G communications system.

In addition, because the second end of the first radiator 34c is electrically connected to the first end of the second radiator 32c using the capacitor structure 36c, the antenna 100c can generate different resonance frequencies by adjusting a position of the capacitor structure 36c between the second end of the first radiator 34c and the first end of the second radiator 32c. Furthermore, a value of the capacitor structure may be determined according to areas of metal plates, a distance between two parallel metal plates, and a dielectric constant of a medium between the two parallel metal plates, where a calculation formula is C=er×A/d, where C is a capacitance value, er is the dielectric constant of the medium between the two parallel metal plates, A is a cross-sectional area of the two parallel metal plates, and d is the distance between the two parallel metal plates. Therefore, the capacitance value is adjusted by adjusting values of er, A, and d.

Figure 11:
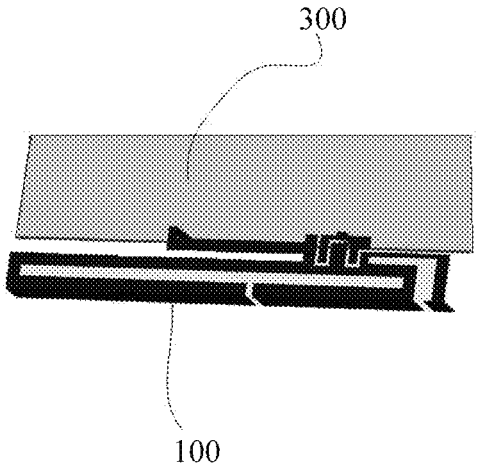
FIG. 11 is another schematic diagram of assembly of a circuit board and an antenna that are of a mobile terminal according to the present disclosure.

Referring to both FIG. 10 and FIG. 11, FIG. 10 and FIG. 11 show a mobile terminal according to an embodiment of the present disclosure, where the mobile terminal may be an electronic apparatus such as a mobile phone, a tablet computer, or a personal digital assistant.

The mobile terminal 300 in the present disclosure includes an antenna 100, a radio frequency processing unit, and a baseband processing unit. The radio frequency processing unit and the baseband processing unit may be disposed on a circuit board 300. The baseband processing unit is connected to a feed source 40 of the antenna 100 using the radio frequency processing unit. The antenna 100 is configured to transmit a received radio signal to the radio frequency processing unit, or convert a transmit signal of the radio frequency processing unit into an electromagnetic wave, and transmit the electromagnetic wave. The radio frequency processing unit is configured to perform frequency selection, amplification, and down-conversion processing on the radio signal received by the antenna, convert the radio signal into an intermediate frequency signal or a baseband signal, and transmit the intermediate frequency signal or the baseband signal to the baseband processing unit, or is configured to transmit, using the antenna, a baseband signal or an intermediate frequency signal that is sent by the baseband processing unit and that is obtained by means of up-conversion and amplification, and the baseband processing unit is configured to perform processing on the received intermediate frequency signal or the received baseband signal.

The antenna in the mobile terminal may be any antenna in the foregoing antenna embodiments. The baseband processing unit may be connected to the circuit board. As shown in FIG. 10, in an implementation manner, a first radiation part 30 of the antenna 100 may be located on an antenna bracket 200. The antenna bracket 200 may be an insulation medium, disposed on one side of the circuit board 300, and disposed in parallel with the circuit board 300, or may be fastened to the circuit board 300. Optionally, the first radiation part 30 of the antenna may also be suspended in the air (as shown in FIG. 11), where a second radiation part 39c, a third radiation part 38c, and a fourth radiation part 37c may also be located on the antenna bracket 200, and certainly, the second radiation part 39c, the third radiation part 38c, and the fourth radiation part 37c may also be suspended in the air.

According to the mobile terminal provided in this embodiment of the present disclosure, a first end and a second end of a second radiator 32 of the antenna 100 are utilized to form a parallel-distributed inductor in a composite right/left-handed transmission line principle, and the capacitor structure is a series-distributed capacitor structure in the composite right/left-handed transmission line principle such that a length of the second radiator 32 is one-eighth of a wavelength corresponding to the low frequency, thereby reducing a length of the antenna 100, and further reducing a volume of the mobile terminal.

The foregoing descriptions are exemplary implementation manners of the present disclosure. It should be noted that a person of ordinary skill in the art may make several improvements and polishing without departing from the principle of the present disclosure and the improvements and polishing shall fall within the protection scope of the present disclosure.

What is claimed is:

1. An antenna comprising:

a first radiation part configured to generate a first frequency and comprising:

a capacitor structure configured as a series-distributed capacitor structure in a composite right/left-handed transmission line configuration;

a first radiator comprising a first end and a second end; and a second radiator configured as a parallel distributed inductor in the composite right/left-handed transmission line configuration and comprising:

a first end coupled to the second end of the first radiator using the capacitor structure; and a second end coupled to a grounding part, wherein a length of the second radiator is approximately one-eighth of as wavelength corresponding to the first frequency;

a matching circuit;

a feed source coupled to the first end of the first radiator using the matching circuit and coupled to the grounding part; and a second radiation part, wherein a first end of the second radiation part is coupled to the second end of the first radiator, and wherein the second radiation part and the capacitor structure generate a second frequency.

2. The antenna of claim 1, wherein the first radiator and the second radiator are metal sheets, wherein the first radiator and the second radiator are formed on a bracket, and wherein the bracket is an insulation medium.

3. The antenna of claim 1, wherein the capacitor structure is a capacitor.

4. The antenna of claim 1, wherein the second frequency is a high frequency of 1800 megahertz (MHz) to 2650 MHz.

5. The antenna of claim 1, wherein the first frequency is a low frequency of 800 megahertz (MHz) to 920 MHz.

6. The antenna of claim 1, further comprising a third radiation part, wherein a first end of the third radiation part is coupled to the first end of the second radiator, and wherein the third radiation part and the capacitor generate a third frequency.

7. The antenna of claim 6, wherein the third frequency has a higher frequency than the first frequency and the second frequency.

8. The antenna of claim 1, wherein the grounding part is a ground of a circuit board.

9. The antenna of claim 1, Wherein the capacitor structure is a variable capacitor.

10. The antenna of claim 1, wherein each of the second end of the first radiator and the first end of the second radiator comprises branched structures, and wherein the branched structures form the capacitor structure.

11. A mobile terminal comprising:

a baseband processor;

a radio frequency processor coupled to the baseband processor; and an antenna coupled to the radio frequency processor and comprising:

a first radiation part configured to generate a first frequency and comprising:

a capacitor structure configured as a series-distributed capacitor structure in a composite right/left-handed transmission line configuration;

a first radiator comprising a first end and a second end; and a second radiator configured as a parallel distributed inductor in the composite right/left-handed transmission line configuration and comprising:

a first end coupled to the second end of the first radiator using the capacitor structure; and a second end coupled to a grounding part, wherein a length, of the second radiator is approximately one-eighth of a wavelength corresponding to the first frequency;

a matching circuit;

a feed source coupled to the first end of the first radiator using the matching circuit and coupled to the grounding part; and a second radiation part, wherein a first end of the second radiation part is coupled to the second end of the first radiator, and wherein the second radiation part and the capacitor structure generate a second frequency.

12. The mobile terminal of claim 11, wherein the first radiator and the second radiator are metal sheets, wherein the first radiator and the second radiator are formed on a bracket, and wherein the bracket is an insulation medium.

13. The mobile terminal of claim 11, wherein the capacitor structure is a capacitor.

14. The mobile terminal of claim 11, wherein the second frequency is a high frequency of 1800 megahertz (MHz) to 2650 MHz.

15. The mobile terminal of claim 11, wherein the first frequency is a low frequency of 800 megahertz (MHz) to 920 MHz.

16. The mobile terminal of claim 11, wherein the antenna further comprises a third radiation part, wherein a first end of the third radiation part is coupled to the first end of the second radiator, and Wherein the third radiation part and the capacitor generate a third frequency.

17. The mobile terminal of claim 16, wherein the third frequency has a higher frequency than the first frequency and the second frequency.

18. The mobile terminal of claim 11, wherein the mobile terminal further comprises a circuit board comprising a ground, and wherein the grounding part is the ground.

19. The mobile terminal of claim 11, wherein the capacitor structure is a variable capacitor.

20. The mobile terminal of claim 11, wherein each of the second end of the first radiator and the first end of the second radiator comprises branched structures, and wherein the branched structures form the capacitor structure.

* * * * *